US007297002B2

(12) United States Patent
Kostrzewski et al.

(10) Patent No.: US 7,297,002 B2
(45) Date of Patent: Nov. 20, 2007

(54) STACKED ROTARY CONNECTOR ASSEMBLY USING A SPLIT RING CONFIGURATION

(75) Inventors: Andrew Kostrzewski, Garden Grove, CA (US); Kang Lee, Woodland Hills, CA (US); Tomasz Jannson, Torrance, CA (US); Gajendra Savant, Rolling Hills Estates, CA (US)

(73) Assignee: Physical Optics Corporation, Torrance, CA (US)

( * ) Notice: Subject to any disclaimer, the term of this patent is extended or adjusted under 35 U.S.C. 154(b) by 0 days.

(21) Appl. No.: 11/285,592

(22) Filed: Nov. 21, 2005

(65) Prior Publication Data

US 2007/0026696 A1 Feb. 1, 2007

Related U.S. Application Data

(63) Continuation-in-part of application No. 11/190,697, filed on Jul. 27, 2005, and a continuation-in-part of application No. 11/191,094, filed on Jul. 27, 2005.

(51) Int. Cl.
*H01R 33/00* (2006.01)

(52) U.S. Cl. ..... 439/37; 439/165

(58) Field of Classification Search ..... 439/22, 439/31, 37, 165, 640

See application file for complete search history.

(56) References Cited

U.S. PATENT DOCUMENTS

| | | | | |
|---|---|---|---|---|
| 3,355,695 | A * | 11/1967 | Overesch | 439/31 |
| 3,790,858 | A * | 2/1974 | Brancaleone et al. | 174/260 |
| 5,290,191 | A * | 3/1994 | Foreman et al. | 439/225 |
| 6,254,403 | B1 * | 7/2001 | Bernardini | 439/95 |
| 7,094,084 | B2 * | 8/2006 | Lee | 439/165 |
| 2007/0026696 | A1 * | 2/2007 | Kostrzewski et al. | 439/37 |

* cited by examiner

*Primary Examiner*—James Harvey
(74) *Attorney, Agent, or Firm*—Sheppard Mullin Richter & Hampton LLP

(57) ABSTRACT

An improved stacked rotary connector assembly wherein each connector comprises a pair of rings and the rings of each rotary connector thereof are individually split and mechanically separable. Because the input and output rings are each split and separable, any one rotary connector may be removed from the stack without requiring removal of any other rotary connector and without disturbing the input/output buses of the assembly.

8 Claims, 3 Drawing Sheets

STACKED ROTARY CONNECTOR ASSEMBLY USING A SPLIT RING CONFIGURATION

CROSS-REFERENCE TO RELATED APPLICATIONS

The present application takes priority as a continuation-in-part of applications Ser. No. 11/190,697 filed on Jul. 27, 2005 (entitled "Electrical Connector Configured As A Fastening Element") and Ser. No. 11/191,094 filed on Jul. 27, 2005 (entitled "Connector For Harsh Environments").

FIELD OF THE INVENTION

The present invention relates generally to stacked rotary connector assemblies and more specifically to an improvement therein comprising a split ring configuration of the individual connectors within the stack assembly to facilitate removal of a connector from the stack without requiring disassembly of the entire stack.

BACKGROUND ART

The patent applications from which this application claims continuation-in-part priority, disclose disc-shaped electrical connectors which are configured to have male and female components that are interconnected along a common plane regardless of their respective angular positions. This feature permits electrical connection in a wearable snap connector without requiring visual observation during the connection process. It also permits interconnection of such connector components in an automated robotic environment where precise angular orientation may not be easily controlled. Further, this feature facilitates secure electrical interconnection of very large and very heavy connector components such as those required on the deck surface of ships for installation of different deck modules.

As disclosed herein, such disc-shaped connectors have also been used advantageously as rotary connectors where their independence of angular orientation is exploited to maintain contact even after interconnection. Such rotary connectors are typically used where It is necessary to rotate an assembly such as in submarine periscope assemblies and in conjunction with surveillance cameras and the like. Where such rotary disc-shaped connectors are employed in making numerous, multiple interconnections, it is typical to provide such connectors in a stacked configuration with a central common passage as shown for example in prior art FIG. 1.

As seen in FIG. 1, a rotary connector stack assembly comprises five rotary connectors co-axially aligned and having a common central passage. Each rotary connector comprises a pair of coaxial rings including a fixed upper input ring and a rotatable lower output ring. A plurality of inputs is received at the uppermost (first) rotary connector, one of the inputs being connected at the upper fixed input ring of the first connector and a corresponding output available at the lower rotatable output ring of the first connector. The remaining inputs are channeled through the passage toward the second rotary connector. The inputs and outputs may be low frequency electrical signals carried on conventional wires, as well as microwave signals carried on coax cable and optical signals carried on optical fibers. This arrangement is repeated at each rotary connector in the stack, a different input being affixed to the corresponding input ring at each connector. All of the outputs are available adjacent the stack below the fifth rotary connector. In this manner, the various inputs may be fed to receivers, meters, lights, scopes, etc. connected to the respective rotatable output rings and which rotate synchronously with the rotatable rings. Typically, all of the rotatable output rings are tied together mechanically so that they all rotate synchronously. Furthermore, it will be understood that all of the rings are axially contiguous to one another as shown in FIG. 1A, the apparent gap in FIG. 1 between the lower ring of each rotary connector and the upper ring of each subsequent rotary connector, being for purposes of illustration only. It will also be understood that the number of such rotary connectors in a stack assembly can be considerably greater than five. For example, in a typical periscope application, the number of connectors in a stack can be 15 to 20 more. Moreover, a typical rotary connector stack will have an outer cylindrical housing which may be a unitary structure.

One significant problem associated with the prior art rotary connector stack assembly of FIG. 1, arises when for maintenance or repair purposes, it becomes necessary to remove a connector from the stack. This task will require disassembly of the entire stack including removal of the inputs, outputs and at least all other rotary connectors above or below the connector to be removed. At the very least this can be a daunting and very inconvenient task requiring a significant amount of manual labor and downtime. At its worst, this can be a major interruption. For example, where the rotary stack is in a periscope, the need to remove a connector may require a return to a base with facilities for a major overhaul of the entire periscope assembly. The extent of the interruption with submarine deployment anywhere in the world, can be incredibly inconvenient, to say the least. It would be highly desirable if there were a solution to this problem, namely, a way to remove any of the rotary connectors without having to also remove any other of the rotary connectors and without having to remove or otherwise disturb the input and output bus.

SUMMARY OF THE INVENTION

The present invention provides a novel and highly advantageous solution to the aforementioned maintenance problem associated with stacked rotary connector assemblies. The present invention provides an improved stacked rotary connector assembly wherein the rings of each rotary connector thereof are split and mechanically separable. Because the input and output rings are each split and separable, any one rotary connector may be removed from the stack without requiring removal of any other rotary connector and without disturbing the input/output buses of the assembly.

This unique capability in stacked rotary connector assemblies, substantially reduces the labor and downtime required to repair or otherwise maintain an assembly. More significantly, the present invention makes it more likely that replacement of a stacked rotary connector can be accomplished in the field. This advantage is especially significant in regard to submarine periscopes where repair in the field means that it may no longer be necessary for an unscheduled and forced return to a base for repair of a periscope due to a faulty stacked rotary connector assembly.

BRIEF DESCRIPTION OF THE DRAWINGS

The aforementioned objects and advantages of the present invention, as well as additional objects and advantages thereof, will be more fully understood herein after as a result of a detailed description of preferred embodiments when taken in conjunction with the following drawings in which.

DETAILED DESCRIPTION OF PREFERRED EMBODIMENTS

Figure 1:
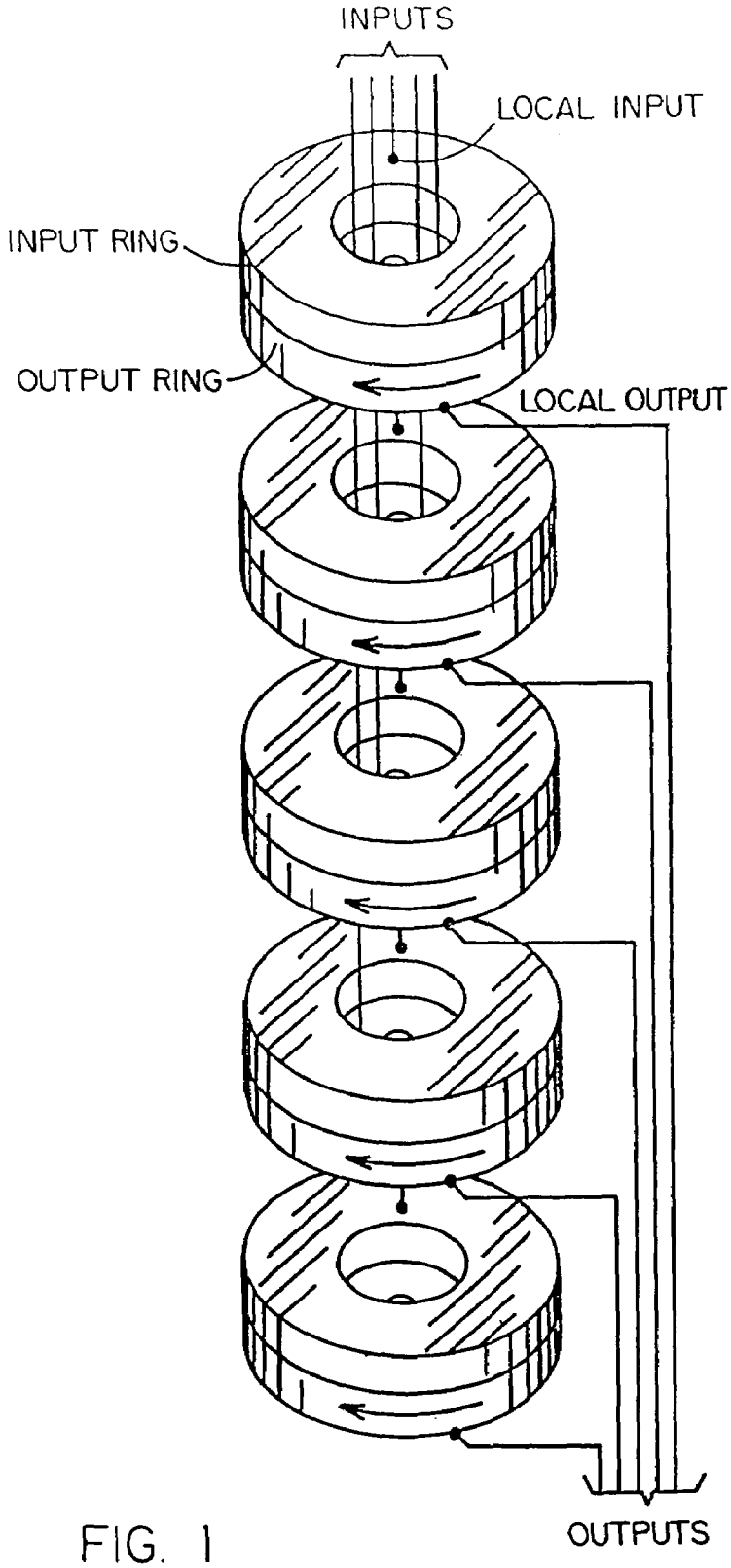
FIG. 1 (PRIOR ART)
FIG. 1 is a prior art, simplified conceptual drawing of a stacked rotary connector assembly which uses conventional ring components.
Figure 1A:
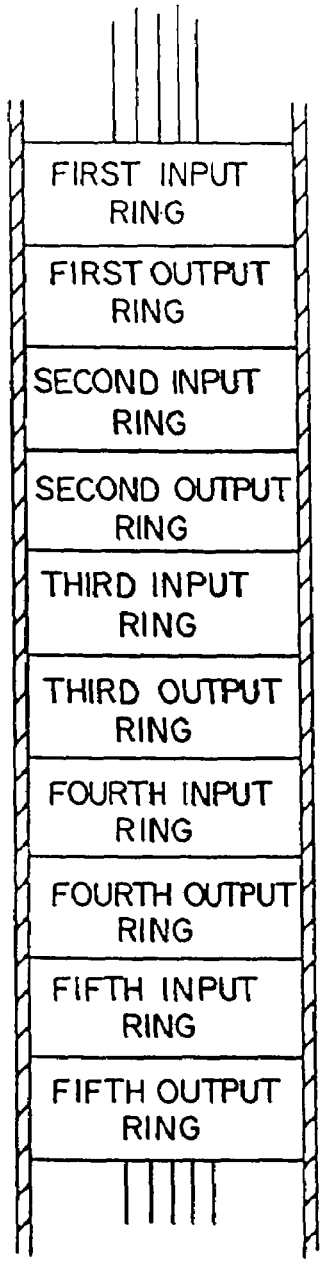
FIG. 1A (PRIOR ART)
FIG. 1A is a prior art drawing of an enclosed stacked rotary connector assembly showing the contiguous relation of connector rings.

Referring to the appended figures and FIGS. 1 and 1A initially, it will be seen that on a conceptual level a conventional stacked rotary connector assembly has a caterpillar-like configuration. It is in general, an elongated cylindrical structure comprising a plurality of axially contiguous rotary connectors. Each such rotary connector comprises a pair of disc-shaped rings or annulus members, one of which can be rotated in either direction while the other one remains fixed. In the configuration illustrated in FIG. 1, the lower ring of each rotary connector is rotatable and the upper ring remains fixed. The rings of the connectors are coaxial, each having a central aperture, the apertures being aligned to form a passage through the entire stack assembly. This passage is used to provide a physical path through the assembly for a plurality of signal carriers, i.e., wires, cables, coax, optical fiber, etc. or fluid conductors or combinations thereof, and which are designated as "inputs" in FIG. 1. Each such connector provides, in effect, a local tap for at least one non-rotating input and at least one rotating output and allows each such local tap to be unaffected by the rotary motion of the assembly. At each such rotary connector the "non-tapped" inputs are simply routed through the central passage to the remaining rotary connectors in the stack. As shown in FIG. 1, all of the inputs at the top of the stack, which have been tapped to a corresponding rotary connector, become outputs adjacent the bottom of the stack. All of the outputs rotate around the stack so that they can be connected to devices which rotate synchronously with the rotatable rings. As seen in FIG. 1A, all of the rotary connectors in the stack (including their respective rings) are in a substantially contiguous relation where the fixed ring of one rotary connector is immediately adjacent the rotatable ring of the next rotary connector. There may be very small spaces between them to avoid unnecessary friction during rotary motion, however such spaces are likely to be on the order of millimeters to minimize physical size of the overall stack.

One can readily observe from FIGS. 1 and 1A that the aforementioned problem of removing one or both rings of a particular rotary connector would require either disassembly of the stack or at least temporary removal of all of the inputs and outputs from the central passage. The latter may be difficult or even impossible without disassembling the entire stack because removing the inputs from the central passage would required in most cases, access to the local taps of even those rotary connectors not being replaced.

Figure 2:
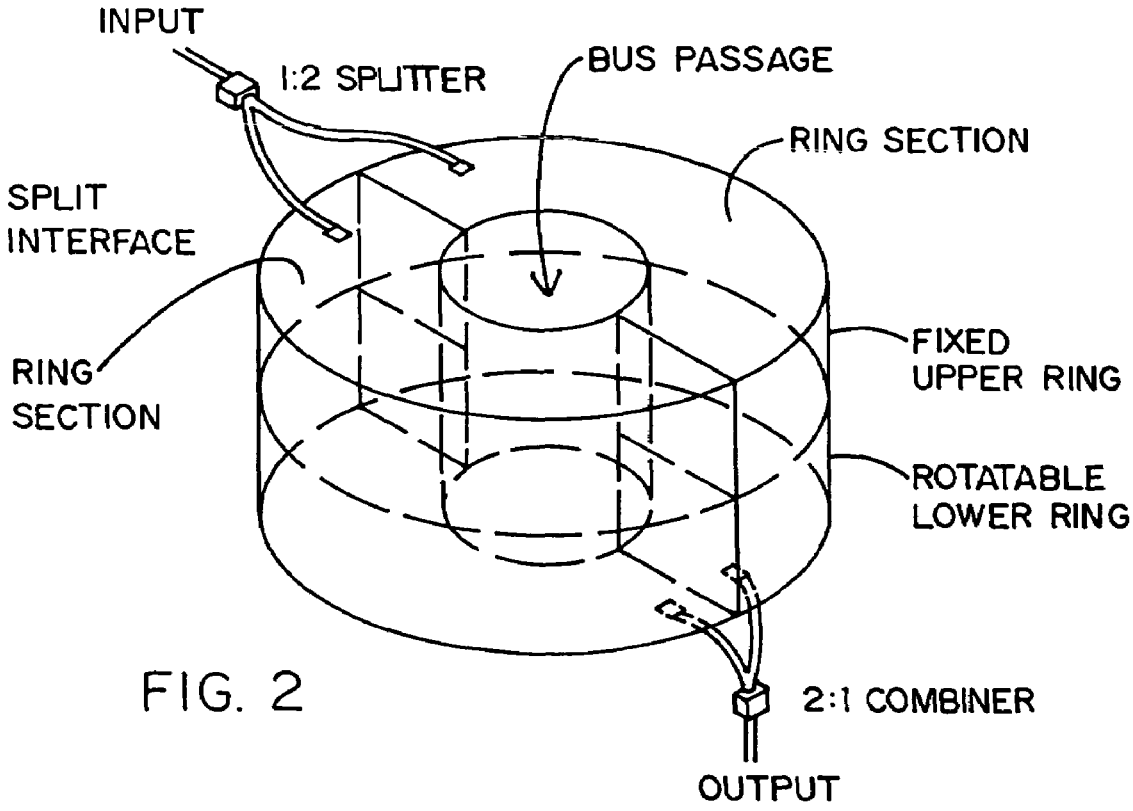
FIG. 2 is a conceptual drawing showing an enlarged three-dimensional view of a unitary ring-type rotary connector having a split configuration in accordance with a preferred embodiment of the invention.
Figure 3:
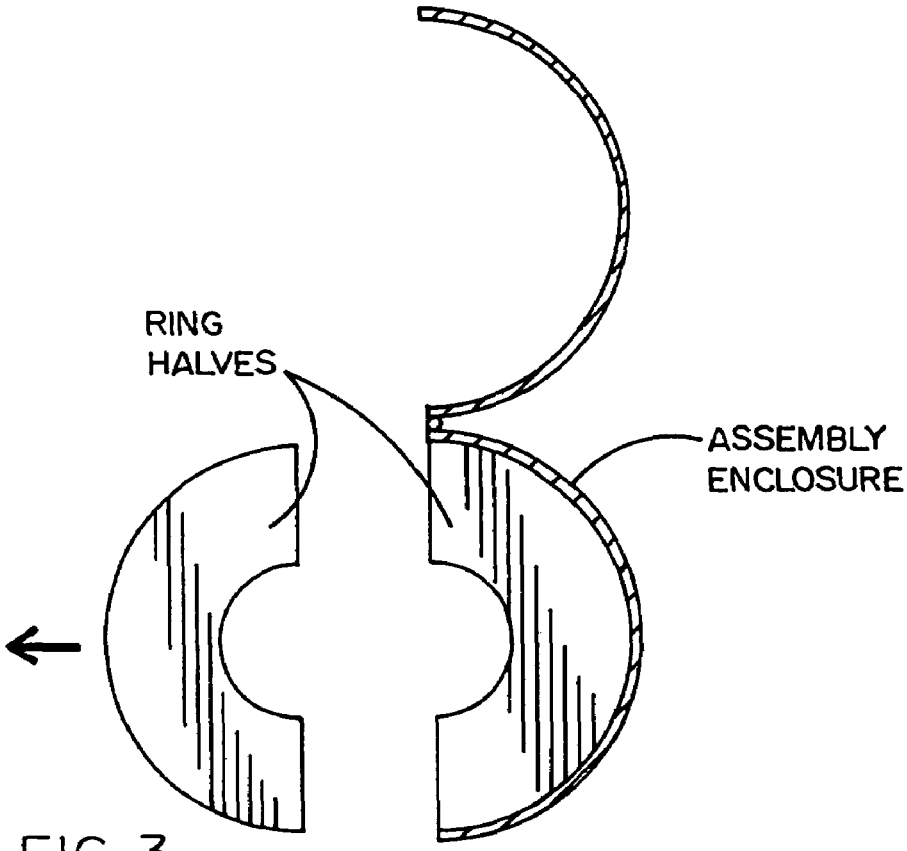
FIG. 3 is a conceptual drawing showing an axial view of a split ring hereof shown partially separated for removal from a stack of rotary connectors through a 180° hinged compartment cover.
Figure 4:
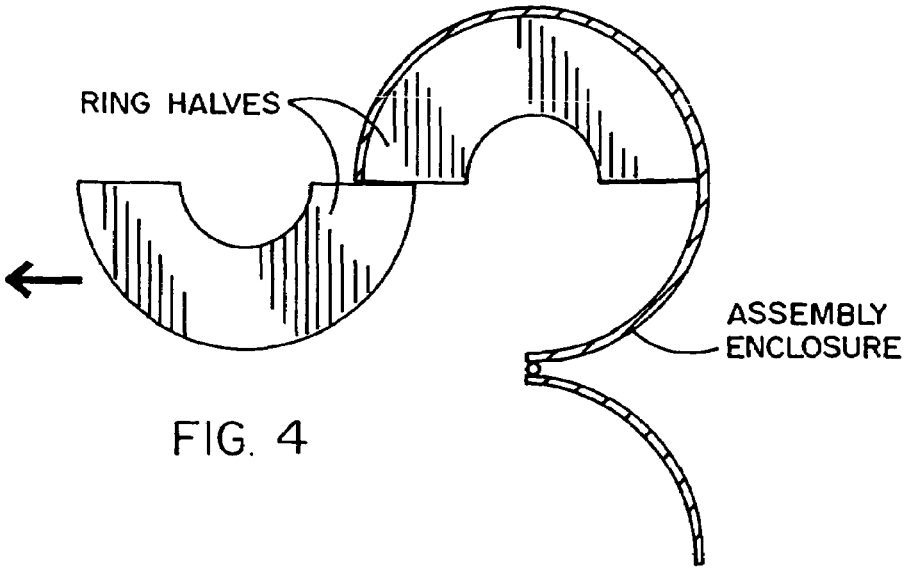
FIG. 4 is an axial view of a split ring hereof shown partially separated for removal from a stack of rotary connectors through a 90° hinged compartment cover.
Figure 5:
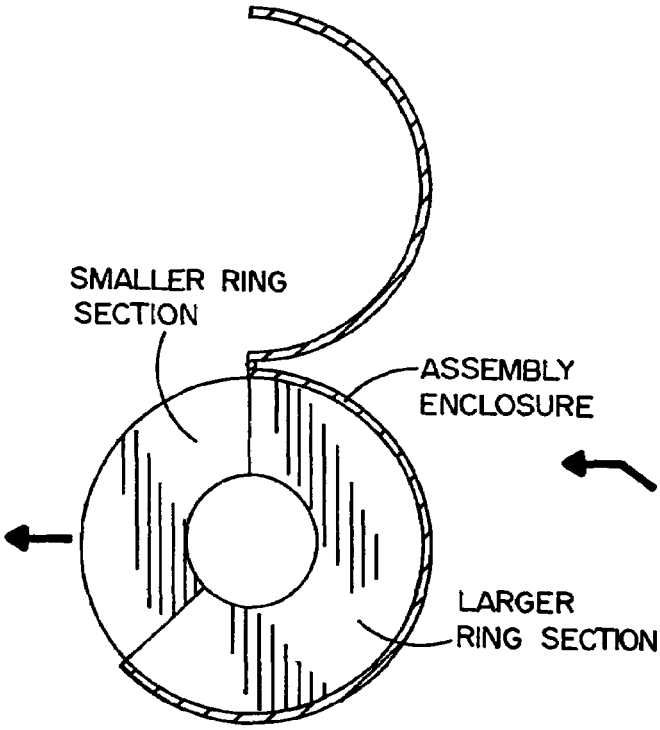
FIGS. 5 and 6 are axial views of a ring split into unequal size sections shown being removed from a stack of rotary connectors.
Figure 6:
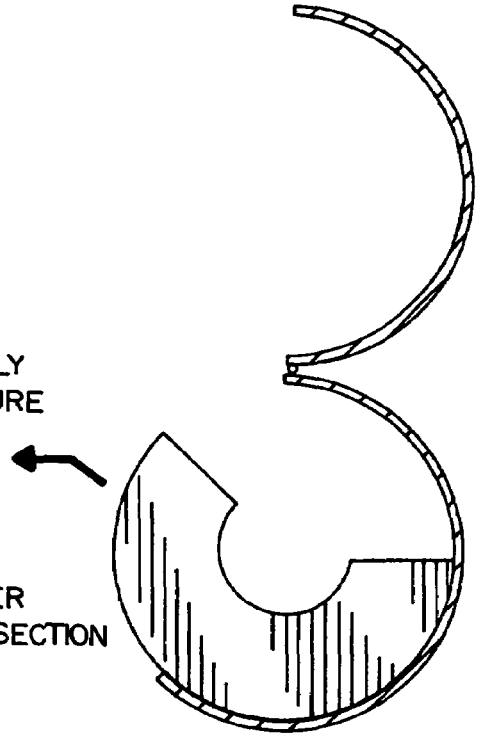

Referring now to FIGS. 2 to 4, it will be seen that the present invention provides a simple and elegant solution to this problem. The solution resides in using an improved rotary connector wherein each ring thereof is split along a surface that cuts through the entire central passage. In the embodiment illustrated in FIG. 2, this surface is a vertical plane which cuts through along the axis of the central passage. Clearly, the cut or split surface need not be planar nor need it be precisely co-linear to the axis of the central passage nor need it cut through even parallel to the central axis. However, it must split the entire central passage from the top to the bottom of the ring to permit withdrawal of the ring without interfering with the inputs passing through the passage. It may actually be preferable to split the ring at the surface offset from the central axis of the passage or at two non-parallel planar surfaces intersecting at the axis to permit easier removal of a smaller section and then subsequent removal of a larger section such as shown in FIG. 5. FIG. 2 also shows a 1:2 out of plane splitter at the input and a 2:1 combiner at the output to utilize both sections of each split ring in the rotary connector.

Having thus disclosed at least one embodiment of the present invention, it will be understood that various modifications and additions are contemplated. Accordingly, the scope hereof is to be limited only by the claims appended hereto and their equivalents.

What is claimed is:

1. An improved rotary connector assembly, the assembly having a plurality of coaxially stacked rotary connectors, each connector having a pair of rings, the connectors each having a central aperture, the apertures of the stacked connectors forming a common passage for receiving signal carriers conveying inputs through the assembly; wherein the improvement comprises:

each said ring of each said connector being split along a surface intersecting said aperture to enable selective removal of a connector from said assembly by withdrawal of each of said rings in at least two sections without substantially affecting any other connector in said assembly; and wherein each said connector has an input and an output, the input having a 1:2 splitter and the output having a 2:1 combiner so that each distinct section of said rings serves a connector function.

2. The improvement recited in claim 1 wherein said common passage has a unitary axis through said connector assembly and wherein said surface intersecting said aperture, intersects said axis.

3. The improvement recited in claim 1 wherein said two sections are congruent to one another.

4. The improvement recited in claim 1 wherein said surface intersecting said aperture creates two ring sections from each said ring, each such section forming a portion of said central aperture.

5. A rotary connector assembly comprising:

a plurality of coaxially stacked rotary connectors, each connector having a pair of rings at least one of which is rotatable, each such ring having a central aperture, the apertures of the rings of said connectors being aligned to form a common passage through said stacked rotary connectors, each of said rings of each of said connectors being split along a surface intersecting said aperture to enable selective removal of a connector from said assembly by withdrawal of each of said rings in at least two distinct sections; and wherein each said connector has an input and an output, the input having a 1:2 splitter and the output having a 2:1 combiner so that each distinct section of said rings serves a connector function.

6. The rotary connector assembly recited in claim 5 wherein said common passage has a unitary axis through said connector assembly and wherein said surface intersecting said aperture intersects said axis.

7. The rotary connector assembly recited in claim 5 wherein said two distinct sections are congruent to one another.

8. The rotary connector assembly recited in claim 5 wherein said surface intersecting said aperture creates two ring sections from each said ring, each such section forming a portion of said central aperture.

* * * * *

UNITED STATES PATENT AND TRADEMARK OFFICE

CERTIFICATE OF CORRECTION

PATENT NO. : 7,297,002 B2
APPLICATION NO. : 11/285592
DATED : November 20, 2007
INVENTOR(S) : Andrew Kostrzewski et al.

It is certified that error appears in the above-identified patent and that said Letters Patent is hereby corrected as shown below:

Col. 1 Line 6-9, insert the following:

--Government Interest
The invention described herein was made with Government support under contract W911QY-04-C-0038 awarded by the U.S.A. Soldier Systems Center in which the Government has certain rights in the invention.--

Signed and Sealed this

Sixteenth Day of December, 2008

JON W. DUDAS
*Director of the United States Patent and Trademark Office*